US008984919B2

(12) United States Patent
Jelin et al.

(10) Patent No.: US 8,984,919 B2
(45) Date of Patent: Mar. 24, 2015

(54) LOCKING SYSTEMS FOR DRAWER BLOCKS OF SUPPORT SYSTEMS

(71) Applicant: Trumpf Medizin Systeme GmbH + Co. KG, Saalfeld (DE)

(72) Inventors: Robert Jelin, Wielenbach (DE); Michael Bartesch, Puchheim (DE); Martin Haenel, Munich (DE)

(73) Assignee: Trumpf Medizin Systeme GmbH + Co. KG, Saalfeld (DE)

( * ) Notice: Subject to any disclaimer, the term of this patent is extended or adjusted under 35 U.S.C. 154(b) by 253 days.

(21) Appl. No.: 13/678,074

(22) Filed: Nov. 15, 2012

(65) Prior Publication Data

US 2013/0118217 A1 May 16, 2013

(30) Foreign Application Priority Data

Nov. 15, 2011 (DE) ..... 10 2011 086 423

(51) Int. Cl.

| | |
|---|---|
| ***E05B 65/46*** | (2006.01) |
| ***E05B 47/00*** | (2006.01) |
| ***A61G 12/00*** | (2006.01) |

(52) U.S. Cl.

CPC ..... *E05B 65/46* (2013.01); *E05B 47/0001* (2013.01); *E05B 47/00* (2013.01); *E05B 65/462* (2013.01); *A61G 12/001* (2013.01)

USPC ..... 70/85; 109/52; 312/215; 700/236

(58) Field of Classification Search

CPC ..... A61J 7/0069; A47F 5/0861; A47F 1/04; A47F 7/024; E05G 1/026; E05G 1/04

USPC ..... 70/85–87; 109/50–52, 56; 312/310, 312/319.7, 209, 333, 223.6, 218, 291, 215; 220/507, 524, 528, 260; 364/479.14; 700/231–244

See application file for complete search history.

(56) References Cited

U.S. PATENT DOCUMENTS

| | | | | |
|---|---|---|---|---|
| 4,155,610 | A * | 5/1979 | Englund | 312/222 |
| 4,182,539 | A * | 1/1980 | Busch | 312/333 |
| 5,487,289 | A | 1/1996 | Otto et al. | |
| 5,805,075 | A | 9/1998 | Carlson et al. | |
| 5,883,806 | A | 3/1999 | Meador et al. | |
| 5,971,593 | A * | 10/1999 | McGrady | 700/233 |
| 6,065,819 | A * | 5/2000 | Holmes et al. | 312/215 |
| 6,788,997 | B1 * | 9/2004 | Frederick | 700/236 |
| 6,902,083 | B1 * | 6/2005 | Michael et al. | 221/75 |
| 7,668,620 | B2 * | 2/2010 | Shoenfeld | 700/237 |
| 7,689,317 | B2 * | 3/2010 | McGrady et al. | 700/236 |
| 8,140,187 | B2 * | 3/2012 | Campbell et al. | 700/242 |

(Continued)

FOREIGN PATENT DOCUMENTS

| | | |
|---|---|---|
| DE | 4101744 A1 | 7/1992 |
| DE | 4422073 A1 | 1/1995 |

(Continued)

*Primary Examiner* — Suzanne Barrett

(74) *Attorney, Agent, or Firm* — Fish & Richardson P.C.

(57) ABSTRACT

A drawer block of a support system, the drawer block including at least one drawer accommodation including a housing defining a receptacle, a drawer including a lock having an actuator and a mechanism configured to lock the drawer in the receptacle of the drawer accommodation, and a receiver assembly that is electrically connected to the actuator and configured to convert an opening signal to an opening instruction for the actuator.

25 Claims, 6 Drawing Sheets

(56) References Cited

U.S. PATENT DOCUMENTS

| | | | | |
|---|---|---|---|---|
| 8,423,180 | B1 * | 4/2013 | Frederick et al. | 700/236 |
| 8,820,622 | B2 * | 9/2014 | Chen et al. | 232/15 |
| 2002/0165641 | A1 * | 11/2002 | Manalang et al. | 700/237 |
| 2004/0026589 | A1 | 2/2004 | Kreuzer et al. | |
| 2004/0108795 | A1 | 6/2004 | Meek et al. | |
| 2008/0231154 | A1 | 9/2008 | Rudduck et al. | |
| 2008/0307837 | A1 | 12/2008 | Greiner et al. | |
| 2009/0212670 | A1 | 8/2009 | Bustle et al. | |
| 2010/0004780 | A1 | 1/2010 | Rickelhoff | |
| 2010/0114367 | A1 * | 5/2010 | Barrett et al. | 700/236 |
| 2011/0196538 | A1 | 8/2011 | Michael | |
| 2012/0259458 | A1 * | 10/2012 | Barrett et al. | 700/237 |

FOREIGN PATENT DOCUMENTS

| | | | |
|---|---|---|---|
| DE | 10057556 | A1 | 5/2002 |
| EP | 1374794 | A1 | 1/2004 |
| EP | 2312099 | A2 | 4/2011 |
| WO | WO0157346 | A1 | 8/2001 |
| WO | 2005002488 | A1 | 1/2005 |
| WO | 2006076762 | A1 | 7/2006 |
| WO | 2007095222 | A2 | 8/2007 |
| WO | 2012142314 | A1 | 10/2012 |

* cited by examiner

LOCKING SYSTEMS FOR DRAWER BLOCKS OF SUPPORT SYSTEMS

CROSS REFERENCE TO RELATED APPLICATION

This application claims priority under 35 U.S.C. §119(a) to German Application No. 10 2011 086 423.7, filed on Nov. 15, 2011, the entire contents of which are hereby incorporated by reference.

TECHNICAL FIELD

The present disclosure relates to locking systems for drawer blocks of support systems (e.g., to locking systems for drawer blocks that are mountable to support systems).

BACKGROUND

Drawer blocks may be mounted to support systems, such as support heads of medical care units. Such drawer blocks include one or more drawers. The drawers are either typically individually or commonly lockable in a fixed configuration by a central locking mechanism. Locking takes place by a mechanical lock and a key. The key must be available to open the one or more drawers. In order to limit unauthorized access to the one or more drawers, duplication of the key is typically minimized, but the key will still need to be provided to authorized persons.

Trolleys having several drawers may be used to store medicine and medical devices. A particular drawer can be unlocked by inputting a code via a keyboard. However, in some cases, the drawers are located in a single housing, and the arrangement of the drawers within the housing cannot be changed. Accordingly, rearrangement of such a support system is generally not possible, thereby preventing a desirable (e.g., ergonomic) arrangement of the drawers.

SUMMARY

In one aspect of the invention, a locking system for a drawer block of a support system enables variable arrangement of drawer blocks on the support system, and the drawers can be opened (e.g., unlocked) by inputting a code.

In another aspect of the invention, a drawer block of a support system includes at least one drawer accommodation including a housing defining a receptacle, a drawer including a lock having an actuator and a mechanism configured to lock the drawer in the receptacle of the drawer accommodation, and a receiver assembly that is electrically connected to the actuator and configured to convert an opening signal to an opening instruction for the actuator.

In some embodiments, the drawer block further includes a fixing mechanism, by which the drawer block is mountable to the support system.

In certain embodiments, the fixing mechanism is mountable to the support system and removable from the support system without usage of a tool.

In some embodiments, the mechanism of the lock is a ratchet that is configured to engage with the locking mechanism.

In certain embodiments, the lock includes a biasing member that forces the ratchet to a position, where the ratchet engages with the locking mechanism so that the drawer is locked, when the opening instruction is not applied to the actuator.

In some embodiments, the lock includes a biasing member that forces the ratchet to a position, where the ratchet engages with the locking mechanism so that the drawer is locked, when electric power is not applied to the actuator.

In certain embodiments, the ratchet engages with the locking mechanism along a locking direction, and the ratchet includes a surface that extends at an acute angle along the locking direction so that while the drawer is being closed, the ratchet is pressed by the locking mechanism in a direction against the locking direction.

In some embodiments, the actuator includes a DC-motor having a gear mechanism.

In certain embodiments, the lock includes a mechanical release mechanism to unlock the lock.

In some embodiments, the drawer block includes a battery, and the actuator and the receiver assembly are connected to the battery.

In certain embodiments, the drawer block includes solar cells, and the actuator and the receiver assembly are connected to the solar cells.

In some embodiments, the support system includes an electrical component, and the drawer accommodation includes a contact that is connected to the receiver assembly and formed such that an electrical connection between the receiver assembly and the electrical component of the support system can be established by the contact for supplying electrical power to and/or controlling the actuator.

In certain embodiments, the contact is integrated with a fixing mechanism by which the drawer block is mountable to the support system.

In some embodiments, the electrical component of the support system includes a bus system having a power supply.

In certain embodiments, the bus system includes a converting board and an emitter assembly, the converting board is configured to process input signals and to generate an output signal, and the emitter assembly is configured to receive the output signal and to transmit the opening signal.

In some embodiments, the emitter assembly includes a modulation device that is configured to modulate the opening signal and to transmit the opening signal to the receiver assembly via the bus system.

In certain embodiments, the drawer block further includes a code input device.

In some embodiments, the code input device is provided on the drawer block.

In certain embodiments, the drawer block further includes a memory unit and a code that is allocated to the drawer block or to the drawer and that is stored in the memory unit.

In some embodiments, the support system is a portion of a medical care unit.

In certain embodiments, the housing of the drawer accommodation includes two side walls, a rear wall, and a platform that cooperate to define the receptacle.

In some embodiments, the support system includes at least one columnar-shaped support member.

In certain embodiments, the support system is a portable cart.

The locking system of the drawer block can advantageously enable at least a variable arrangement of the drawer block on the support system via the receiver assembly of the drawer block and a fixing mechanism for the drawer accommodation.

Other aspects, features, and advantages will be apparent from the description, the drawings, and the claims.

DETAILED DESCRIPTION

Figure 1:
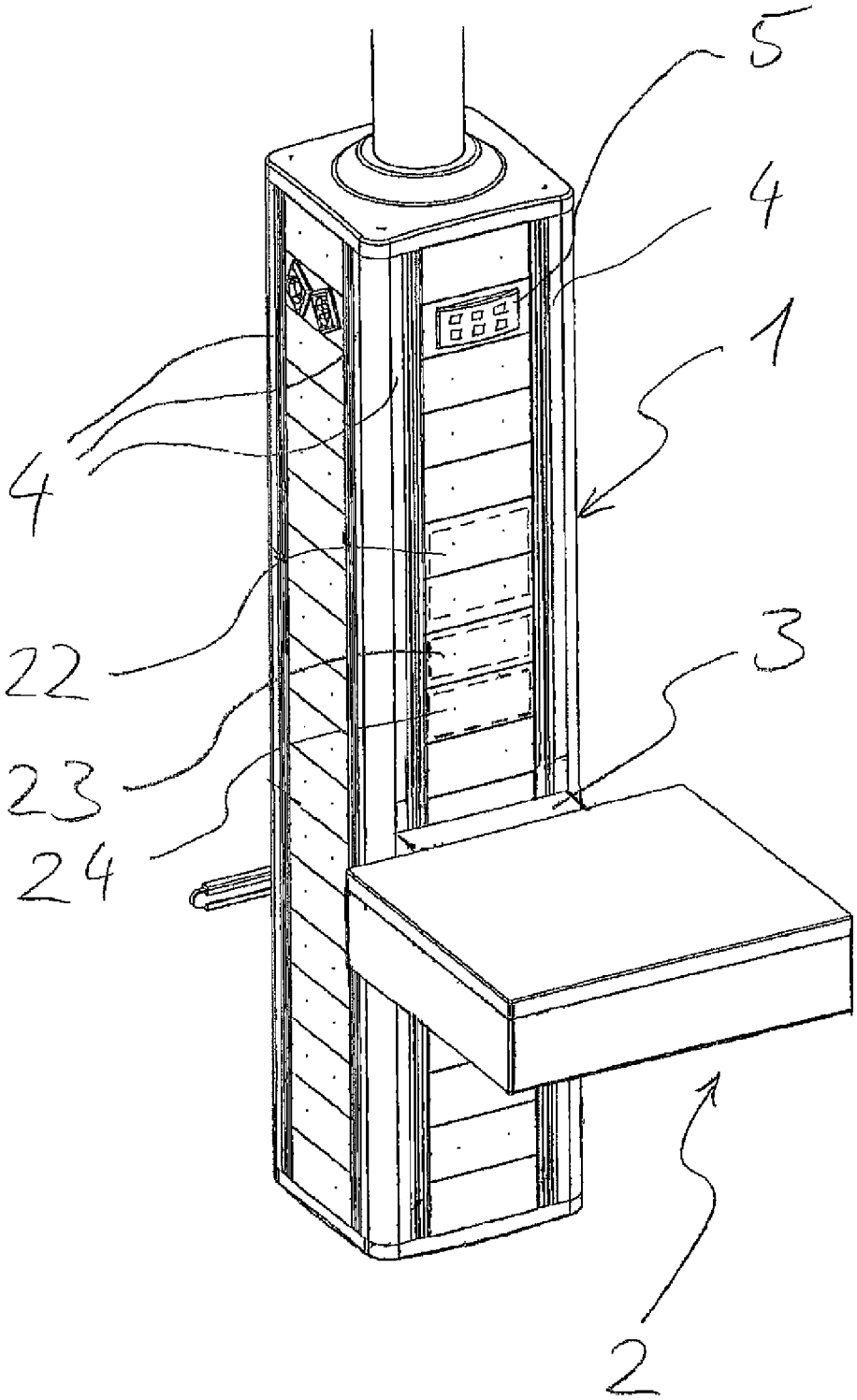
FIG. 1 is a perspective view of a support system including a drawer block.

FIG. 1 is a perspective view of a support system 1, which is a support head of a medical care unit. A drawer block 2 is mounted to the support system 1. The drawer block 2 includes a fixing mechanism 3, by which the drawer block 2 is mounted to the support system 1. The support system 1 further includes two longitudinal depressions 4 located on each side of the support system along respective longitudinal edges near corners of the support system 1. The fixing mechanism 3 is coupled to two longitudinal depressions 4 located on one side of the support system 1. Within the longitudinal depressions 4, holding rails are provided to engage with the fixing mechanism 3. The holding rails are formed such that the fixing mechanism 3 can either be mounted thereto at a particular (e.g., discrete) height along the longitudinal depressions 4 or, alternatively, mounted at any height along the longitudinal depressions 4 (e.g., mounted in a stepless manner). The fixing mechanism 3 and therefore the drawer block 2 can be mounted to any side of the support system 1.

Current bars are located within the longitudinal depressions 4. The current bars are components of a bus system. Electrical components (e.g., accessories) that are connected to the bus system are thereby supplied with energy and controlled. For this purpose, the current bars are connected to a power supply 22 and, in some cases, to a filter print acting as a power supply. The current bars provide an electrical mechanism of the support system 1.

Still referring to FIG. 1, the support system 1 further includes a converting board 23. The converting board 23 is configured such that it can process several input signals. Additionally, the converting board 23 simulates an opening signal for an emitter assembly 24. The emitter assembly 24 creates a modulated opening signal and transmits the opening signal to the bus system.

The support system 1 further includes a code input device 5. The code input device 5 (e.g., a keypad) is connected to the converting board 23. The code input device 5 provides an input that unlocks locks of the mounted drawer block 2. The code input device 5 can also be used for additional control functions, such as controlling brakes.

Figure 2:
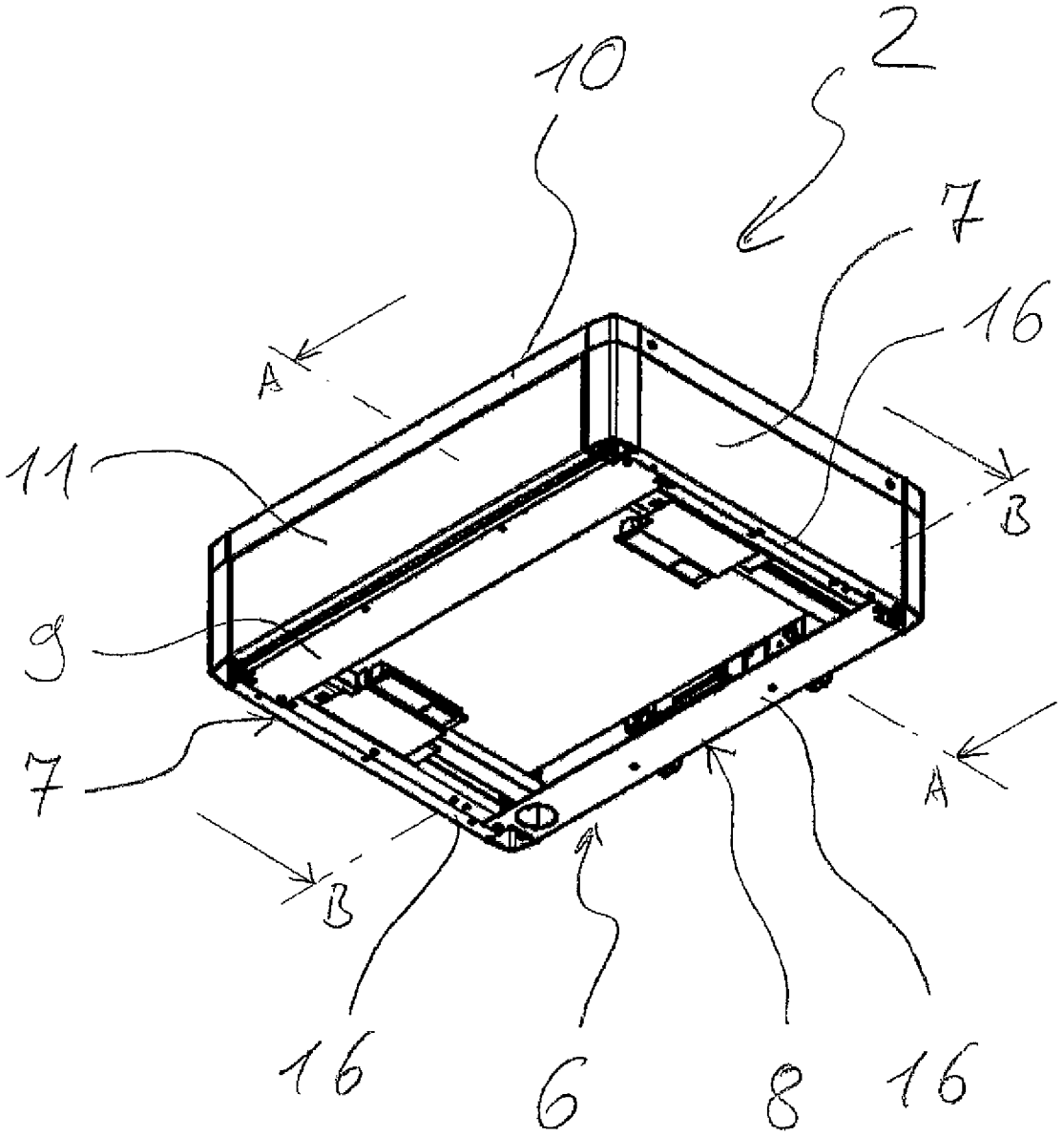
FIG. 2 is a perspective bottom view of a portion of the drawer block of the support system of FIG. 1.

FIG. 2 is a perspective bottom view of the drawer block 2 without a covering plate. The drawer block 2 includes a drawer accommodation 6 (e.g., a housing defining a cavity or a receptacle that receives a drawer 11). The drawer accommodation 6 includes two sidewalls 7, a rear wall 8, and a reinforcement 9. The drawer accommodation 6 is covered at its top by a platform 10. The sidewalls 7 and the rear wall 8 are arranged to provide horizontal legs 16 at a lower side of the drawer block 2. In some cases, built-in components can be fixed to the horizontal legs 16. At the lower side of the drawer accommodation 6, a lower covering plate (not shown) can be provided at the horizontal legs 16. In some embodiments, several drawer accommodations 6 can be mounted one below the other.

In some embodiments, the drawer accommodation 6 is formed within the support system 1.

Still referring to FIG. 2, the drawer accommodation 6 includes the drawer 11 that is mounted to the drawer accommodation 6 by a drawer mechanism. The drawer mechanism enables the drawer 11 to be retracted from the drawer accommodation 6 by a predetermined distance. Furthermore, the drawer mechanism may provide additional functions, such as a self-retraction functionality of the drawer 11 or a push-to-open mechanism of the drawer 11.

In some embodiments, the drawer accommodation 6 is sized such that several drawers 11 fit within the drawer accommodation 6. In such embodiments, the drawers 11 can be arranged one below the other or adjacent to each other within the drawer accommodation 6.

Figure 3:
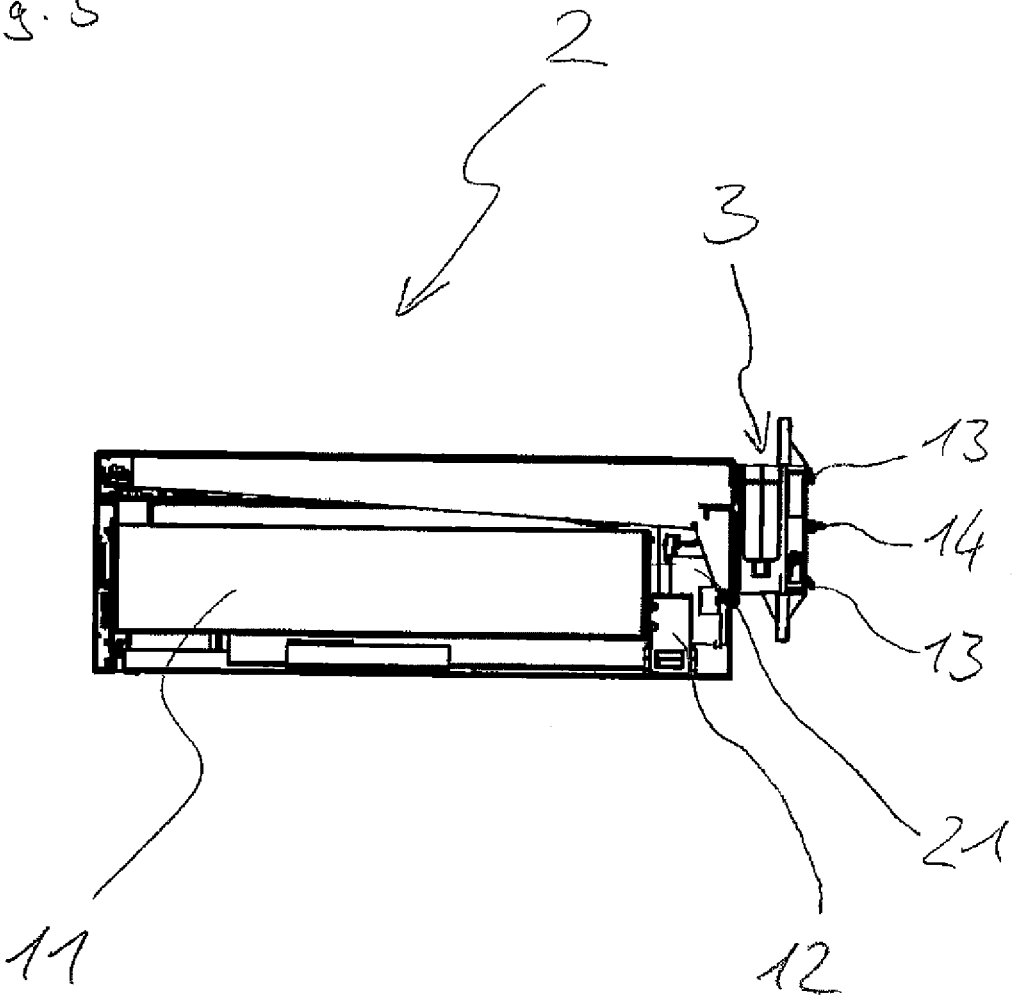
FIG. 3 is a cross-sectional view of the drawer block of FIG. 2, shown along the section line A-A in FIG. 2.

FIG. 3 is a cross-sectional view of the drawer block 2, shown along the section line A-A in FIG. 2. The drawer 11 is provided with a locking mechanism 12. The locking mechanism 12 is typically mounted to the rear side of the drawer 11. However, in some embodiments, the locking mechanism 12 is positioned along a lateral surface of the drawer 11 or at a top or bottom surface of the drawer 11. In the embodiment shown in FIG. 3, the locking mechanism 12 is an angled sheet that includes a rectangular recess. The locking mechanism 12 is configured such that a leg of the angled sheet, in which the rectangular recess is located, extends parallel to an extract direction of the drawer 11.

The fixing mechanism 3, located at the rear side of the drawer block 2, is provided with hooks 13, by which the drawer block 2 can be hooked to the longitudinal depressions 4 (shown in FIG. 1) within the holding rails. The fixing mechanism 3 is further provided with a locking mechanism (not shown) that prevents unintended unhooking of the drawer block 2 from the longitudinal depressions 4. Such locking mechanism can be manually operated so that the fixing mechanism 3 and therefore the drawer block 2 can be mounted to and removed from the support system 1 without using any tool.

In some embodiments, the fixing mechanism 3 can also be secured to the longitudinal depressions 4 by a screw rivet. In this manner, additional protection is provided against mechanical jarring of the drawer block 2 and unintended unlocking.

Additionally, as shown in FIG. 3, a contact mechanism 14 is provided at the fixing mechanism 3. The contact mechanism 14 engages the fixing mechanism 3 at two locations. The contact mechanism 14 is connected within the drawer block 2 to an actuator, as will be described in detail below. The contact mechanism 14 is configured to automatically form a contact between an electrical component of the drawer block 2 and an electrical mechanism of the support system 1 while the drawer block 2 is being hooked into the support system 1.

In some embodiments, the contact mechanism 14 is not integrated with the fixing mechanism 3, but instead provided at another location. Furthermore, an automatic contact is not required, and thus, a contact can separately occur in an alternative manner.

The drawer block 2 further includes a receiver assembly 21, as will be described in more detail below.

Figure 4:
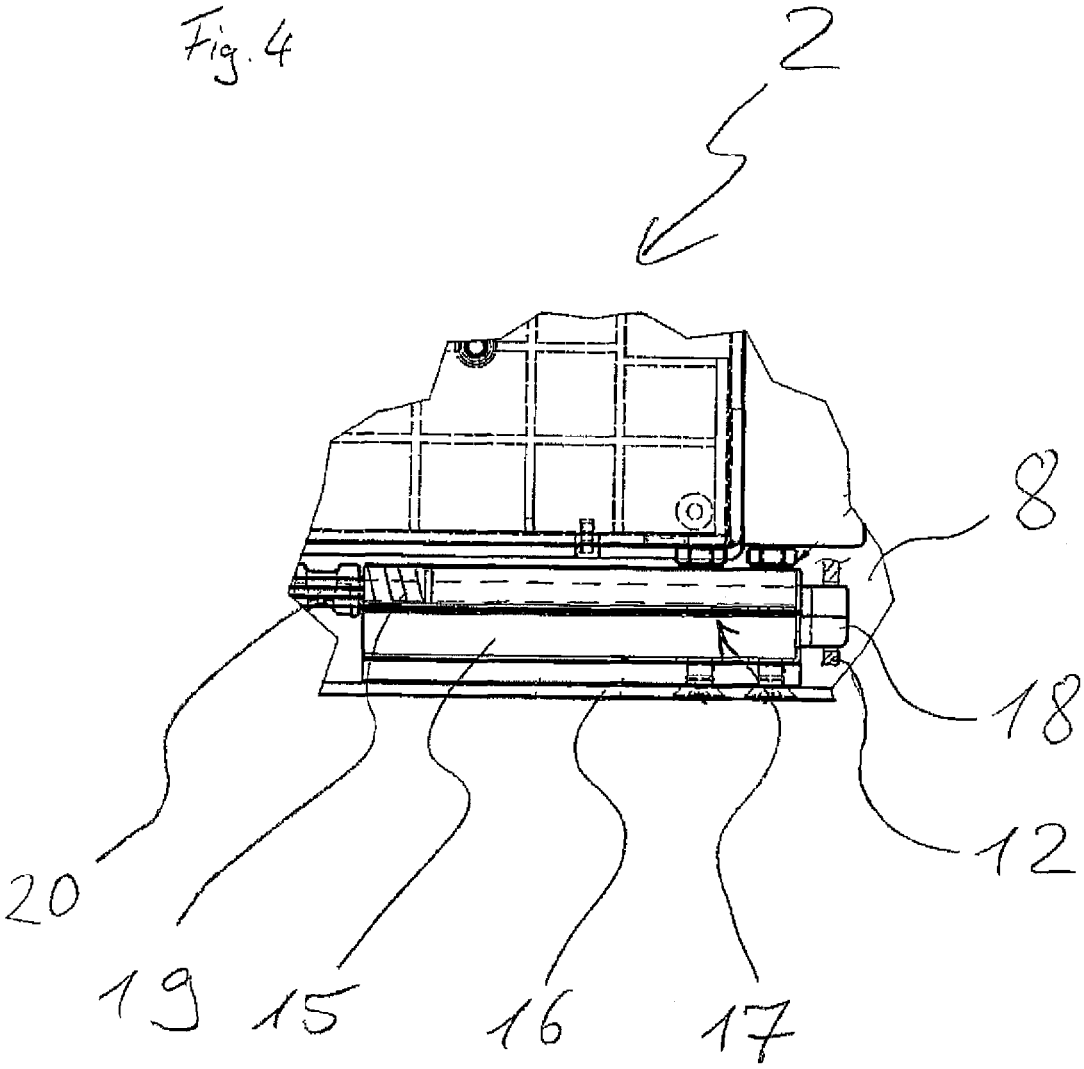
FIG. 4 is a cross-sectional view of a portion of the drawer block of FIG. 2, shown along the section line B-B in FIG. 2.

FIG. 4 is a cross-sectional view of a portion of the drawer block 2, shown along the section line B-B in FIG. 2 (i.e., an internal view showing an inner side of the rear wall 8. A lock 15 is fixed at the horizontal leg 16 of the rear wall 8.

The lock 15 includes an actuator 17. The actuator 17 is connected to the locking mechanism 12 by a ratchet 18, in a manner such that the ratchet 18 can be moved by the actuator 17. The ratchet 18 is connected to a biasing member 19, such that the ratchet 18 can be forced to a right side by the biasing member 19 into an extracted position. In the extracted position, the ratchet 18 engages with the rectangular recess of the locking mechanism 12 so that the drawer 11 is locked.

In the embodiment of FIG. 4, the actuator 17 is provided as a DC-motor that has a gear mechanism. However, in some embodiments, the actuator 17 can be provided with another actuation mechanism (e.g., an electromagnet). In certain embodiments, the lock 15 can be configured to provide the ratchet 18 with at least two controllable positions as an alternative to the biasing member 19.

In some embodiments, the actuator 17 is formed as an electric coil, and the lock 15 includes as a locking mechanism an electromagnet that is activated by the electric coil. The electromagnet cooperates with a corresponding counter-surface at the drawer 11 in order to lock the drawer 11.

The lock 15 further includes a mechanical emergency unlock or release 20, by which the ratchet 18 can be moved out of the extracted position. In this manner, the ratchet 18 can disengage from the locking mechanism 12, and the drawer 11 can be opened. The emergency unlock 20 is accessible in the drawer block 2, which opens at its bottom side.

In some embodiments, the drawer 11 is provided with a locking mechanism that includes the lock 15 and the actuator 17 for the drawer block 2 and the support system 1, respectively.

Figure 5:
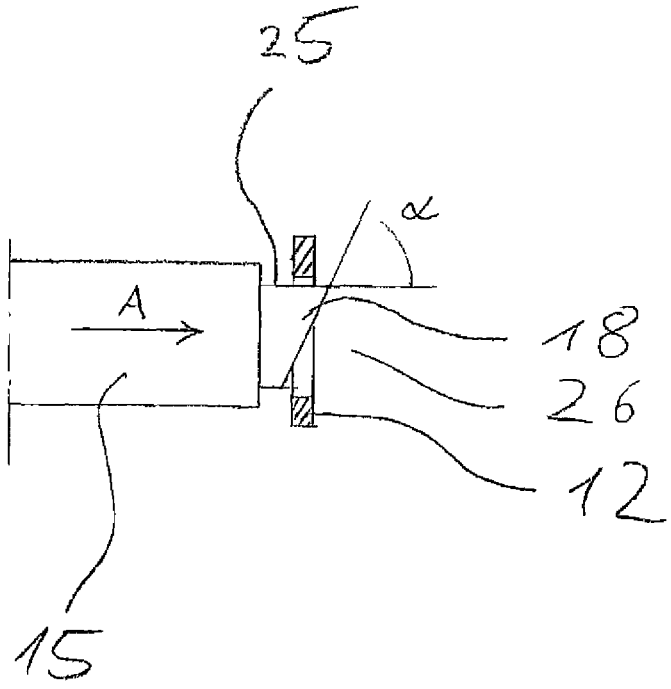
FIG. 5 is a front view of a mechanical block including a ratchet that engages with a locking mechanism.

FIG. 5 is a front view of a mechanical block that includes the ratchet 18, which engages the locking mechanism 12. The ratchet 18 includes a surface 26 that is located at a frontal end of the ratchet 18. The ratchet 18 is moved towards a locking direction A into the extracted position by the biasing member 19. The surface 26 forms an acute angle $\alpha$ with a lateral surface 25, that is parallel to the locking direction A and that faces the rear wall 8 (shown in FIG. 2). Due to a shape of the ratchet 18, the biased ratchet 18 is pressed towards the locking direction A during sliding in of the drawer 11 with the locking mechanism 12. Since the ratchet 18 is biased by the biasing member 19, the ratchet 18 is moved into the rectangular recess of the locking mechanism 12 once the drawer 11 closes. In this manner, the drawer 11 is automatically locked.

The receiver assembly 21 (shown in FIG. 3) provided in the drawer block 2 is connected to the actuator 17 and the contact mechanism 14. The receiver assembly 21 is connected to the bus system of the support system 1 via the contact mechanism 14.

Referring to FIGS. 1-5, during operation, the drawer block 2 is mounted to the support system 1 at any suitable location by the fixing mechanism 3. In an initial state, the drawer 11 is locked by the ratchet 18 of the lock 15. At this time, the ratchet 18 engages with the rectangular recess of the locking mechanism 12 of the drawer 11.

A pre-defined code is input into the code input device 5, thereby releasing a locking of the drawer 11. At this time, a signal of the code input device 5 is processed by the converting board 23 as the input signal, and the opening signal for the emitter assembly 24 is simulated. The emitter assembly 24 includes a modulator assembly that generates a modulated opening signal and transmits the opening signal to the receiver assembly 21 via the bus system and the contact mechanism 14. The received opening signal is interpreted by the receiver assembly 21, and the receiver assembly 21 transmits an opening instruction to the actuator 17 of the lock 15. The actuator 17 retracts the ratchet 18 from the locking direction A so that the engagement of the ratchet 18 with the rectangular recess of the locking mechanism 12 is released. In this manner, the drawer 11 is unlocked and can be opened for as long as the opening signal is applied to the actuator 17. Once the opening signal is no longer applied to the actuator 17, the ratchet 18 is forced by the biasing member 19 to the extracted position. Closing the drawer 11 is permitted at any time, since the ratchet 18 is moved along the surface 26 from the locking mechanism 12 towards the locking direction A, and the ratchet 18 then engages with the rectangular recess of the locking mechanism 12 and thereby locks the drawer 11.

When the drawer block 2 is removed from the support system 1, the opening signal is then neither applied to the actuator 17, nor is the actuator 17 supplied with electric current. Therefore, the ratchet 18 is forced by the biasing member 19 into the extracted position, and the drawer 11 is automatically locked.

The drawer block 2 can then be attached again to the support system 1 without using any tool and can be connected to the bus system at any other suitable location. The drawer 11 remains locked as long as the opening signal is not emitted from the emitter assembly 24.

In some embodiments, a memory unit can be provided in the drawer block 2. The memory unit stores a condition (e.g., locked or unlocked) of the drawer 11. If the drawer block 2 is mounted again to the support system 1, the condition can then be transmitted to and received by a control mechanism (e.g., the converting board 23, the emitter assembly 24, etc.). This condition information is stored even in a current-less condition of the drawer block 2. In certain embodiments, the condition of the drawer 11 can also be displayed or transmitted as a signal.

The electrical mechanisms of the drawer block 11 (e.g., the receiver assembly 21 and the actuator 17) are provided by the bus system of the support system 1. In some embodiments, a battery/accumulator or a solar cell may alternatively or additionally be provided in the drawer block 2.

In certain embodiments, a code input device can be provided on the drawer block 2, additionally or alternatively to the code input device 5 of the support system 1. If several code input devices are present, the lock 15 of the drawer 11 can then be controlled by any code input device.

The code for a particular drawer is typically stored in the code input device. However, in some embodiments, the code can also be stored in a memory unit in the drawer 11 or in the drawer block 2. Therefore, a code is then allocated to a drawer 11, even when the drawer 11 is mounted to another support system.

Figure 6:
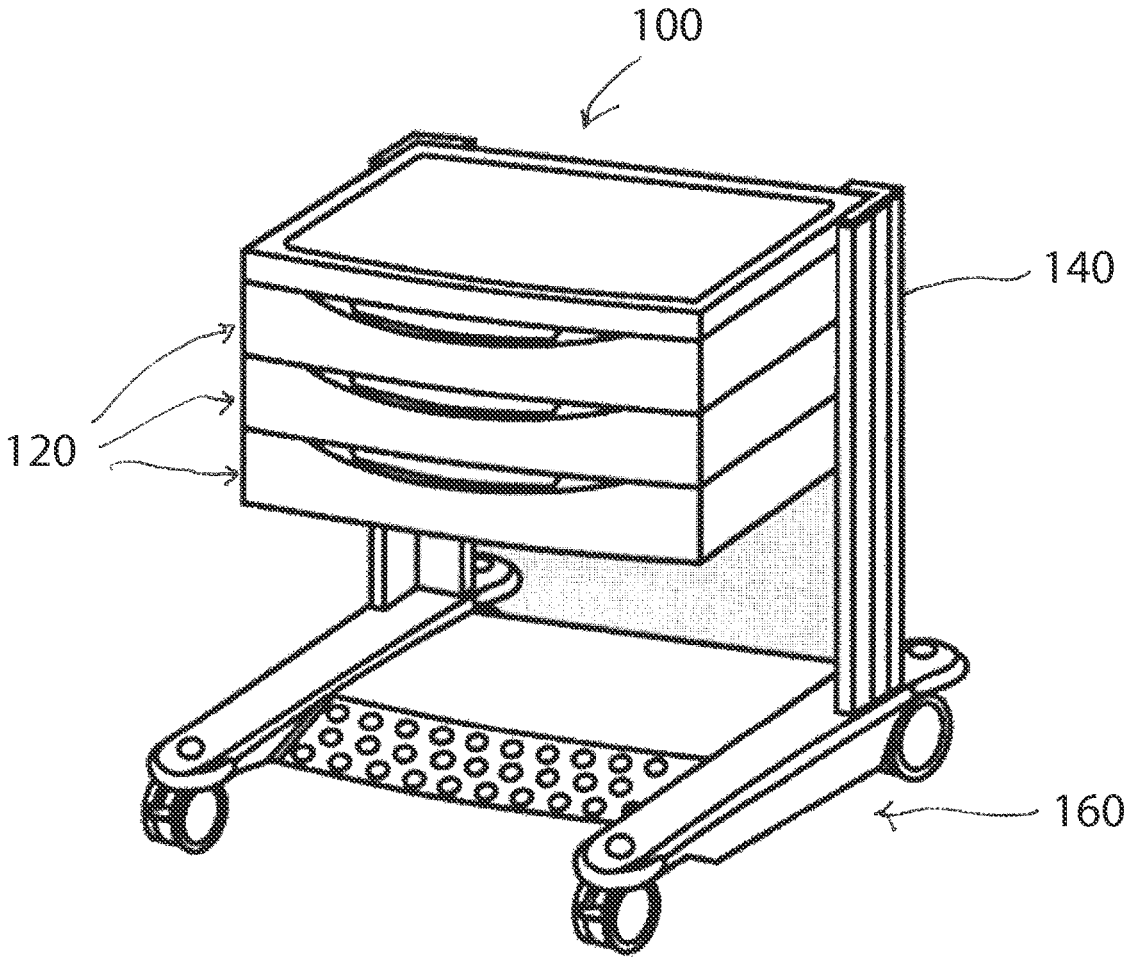
FIG. 6 is a perspective view of a support system including a drawer block.

While the support system 1 has been illustrated and described as a generally columnar-shaped support system (e.g., a support head of a medical care unit), in some embodiments, a support system can include multiple support members to which one or more drawer blocks or drawers are mountable. For example, FIG. 6 is a perspective view of a support system 100, which is a trolley (e.g., a portable cart) that includes three drawer blocks 120 mounted to two spaced apart support members 140 that form a carriage of the support system 100. In some instances, the drawer blocks 120 of the support system 100 may be used to store medicine and medical devices. In addition to the support members 140 and the drawer blocks 120, the support system 100 further includes a wheeled base 160, from which the support members 140 extend vertically.

The drawer blocks 120 are substantially similar in construction and function to the drawer blocks 2, with the exception that the drawer blocks 120 include a fixing mechanism that is configured to engage the support members 140. The support members 140 can include longitudinal depressions that are substantially similar in construction and function to the longitudinal depressions 4 of the support system 1, such that the drawer blocks 120 can be mounted to the support members 140 in a manner substantially similar to that which the drawer block 2 is mounted to the longitudinal depressions 4 of the support system 1. For example, the drawer blocks 120 can be mounted to the support members 140 at particular (e.g., discrete) heights along the support members 140 or, alternatively, mounted at any height along the support members 140 (e.g., mounted in a stepless manner).

The support system 100 further includes the code input device 5 (not shown) disposed along one of the support members 140, and the various electrical components of the support system 1 (e.g., the power supply 22, the converting board 23, and the emitter assembly 24) so that drawers of the drawer blocks 120 may be locked in a closed position and released from the closed position within the drawer blocks 120.

In the example embodiment of FIG. 6, three drawer blocks 120 are disposed adjacent and one below the other, with a top platform having been removed from the two lower drawer blocks 120. However, in some embodiments, a support system may include a different number of drawer blocks 120. Additionally, the drawer blocks 120 may be spaced apart from one another such that all of the drawer blocks 120 may be installed with a top platform that covers the drawer blocks 120.

A number of embodiments have been described. Nevertheless, it will be understood that various modifications may be made without departing from the spirit and scope of the disclosure. Accordingly, other embodiments are within the scope of the following claims.

What is claimed is:

1. A drawer block of a support system, the drawer block comprising:

at least one drawer accommodation comprising a housing defining a receptacle;

a drawer comprising a lock having an actuator and a mechanism configured to lock the drawer in the receptacle of the drawer accommodation; and a receiver assembly that is electrically connected to the actuator and configured to convert an opening signal to an opening instruction for the actuator, wherein the support system comprises an electrical component, and the at least one drawer accommodation comprises a contact that is connected to the receiver assembly and formed such that an electrical connection between the receiver assembly and the electrical component of the support system can be established by the contact for supplying electrical power to and/or controlling the actuator, and wherein the contact is integrated with a fixing mechanism by which the drawer block is mountable to the support system.

2. The drawer block according to claim 1, the drawer block further comprises a fixing mechanism, by which the drawer block is mountable to the support system.

3. The drawer block according to claim 2, wherein the fixing mechanism is mountable to the support system and removable from the support system without usage of a tool.

4. The drawer block according to claim 1, wherein the mechanism of the lock is a ratchet that is configured to engage with a locking member.

5. The drawer block according to claim 4, wherein the lock comprises a biasing member that forces the ratchet to a position, where the ratchet engages with the locking member so that the drawer is locked, when the opening instruction is not applied to the actuator.

6. The drawer block according to claim 4, wherein the lock comprises a biasing member that forces the ratchet to a position, where the ratchet engages with the locking member so that the drawer is locked, when electric power is not applied to the actuator.

7. The drawer block according to claim 4, wherein the ratchet engages with the locking member along a locking direction, and the ratchet comprises a surface that extends at an acute angle along the locking direction so that while the drawer is being closed, the ratchet is pressed by the locking member in a direction against the locking direction.

8. The drawer block according to claim 4, wherein the actuator comprises a DC-motor having a gear mechanism.

9. The drawer block according to claim 4, wherein the lock comprises a mechanical release mechanism to unlock the lock.

10. The drawer block according to claim 1, wherein the drawer block comprises a battery, and the actuator and the receiver assembly are connected to the battery.

11. The drawer block according to claim 1, wherein the drawer block comprises solar cells, and the actuator and the receiver assembly are connected to the solar cells.

12. The drawer block according to claim 1, wherein the electrical component of the support system comprises a bus system having a power supply.

13. The drawer block according to claim 12, wherein the bus system comprises a converting board and an emitter assembly, and wherein the converting board is configured to process input signals and to generate an output signal, and the emitter assembly is configured to receive the output signal and to transmit the opening signal.

14. The drawer block according to claim 13, wherein the emitter assembly comprises a modulation device that is configured to modulate the opening signal and to transmit the opening signal to the receiver assembly via the bus system.

15. The drawer block according to claim 1, further comprising a code input device.

16. The drawer block according to claim 15, wherein the code input device is provided on the drawer block.

17. The drawer block according to claim 1, wherein the drawer block or the drawer comprises a memory unit and a code that is allocated to the drawer block or to the drawer and that is stored in the memory unit.

18. The drawer block according to claim 1, wherein the support system comprises a portion of a medical care unit.

19. The drawer block of claim 1, wherein the housing of the drawer accommodation comprises two side walls, a rear wall, and a platform that cooperate to define the receptacle.

20. The drawer block of claim 1, wherein the support system comprises at least one columnar-shaped support member.

21. The drawer block of claim 1, wherein the support system comprises a portable cart.

22. A drawer block of a support system, the drawer block comprising:

at least one drawer accommodation comprising a housing defining a receptacle;

a drawer comprising a lock that comprises an actuator and a ratchet configured to engage with a locking member to lock the drawer in the receptacle of the drawer accommodation; and a receiver assembly that is electrically connected to the actuator and configured to convert an opening signal to an opening instruction for the actuator, wherein the lock further comprises a biasing member that forces the ratchet to a position, where the ratchet engages with the locking member so that the drawer is locked, when the opening instruction is not applied to the actuator.

23. A drawer block of a support system, the drawer block comprising:

at least one drawer accommodation comprising a housing defining a receptacle;

a drawer comprising a lock that comprises an actuator and a ratchet configured to engage with a locking member to lock the drawer in the receptacle of the drawer accommodation; and a receiver assembly that is electrically connected to the actuator and configured to convert an opening signal to an opening instruction for the actuator, wherein the lock further comprises a biasing member that forces the ratchet to a position, where the ratchet engages with the locking member so that the drawer is locked, when electric power is not applied to the actuator.

24. A drawer block of a support system, the drawer block comprising:

at least one drawer accommodation comprising a housing defining a receptacle;

a drawer comprising a lock that comprises an actuator and a ratchet configured to engage with a locking member to lock the drawer in the receptacle of the drawer accommodation; and a receiver assembly that is electrically connected to the actuator and configured to convert an opening signal to an opening instruction for the actuator, wherein the ratchet engages with the locking member along a locking direction, and the ratchet comprises a surface that extends at an acute angle along the locking direction so that while the drawer is being closed, the ratchet is pressed by the locking member in a direction against the locking direction.

25. A drawer block of a support system, the drawer block comprising:

at least one drawer accommodation comprising a housing defining a receptacle;

a drawer comprising a lock having an actuator and a mechanism configured to lock the drawer in the receptacle of the drawer accommodation;

a receiver assembly that is electrically connected to the actuator and configured to convert an opening signal to an opening instruction for the actuator; and a code input device provided on the drawer block.

* * * * *